US011746655B2

(12) United States Patent
Kirkhope et al.

(10) Patent No.: US 11,746,655 B2
(45) Date of Patent: Sep. 5, 2023

(54) METHOD AND DEVICE FOR MONITORING OPERATION OF A MINING MACHINE UNIT

(71) Applicant: Caterpillar Inc., Peoria, IL (US)

(72) Inventors: Euan Kirkhope, Mayfield (AU); Johannes Wesselmann, Dortmund (DE)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/436,172

(22) PCT Filed: Mar. 2, 2020

(86) PCT No.: PCT/EP2020/025108
§ 371 (c)(1),
(2) Date: Sep. 3, 2021

(87) PCT Pub. No.: WO2020/177930
PCT Pub. Date: Sep. 10, 2020

(65) Prior Publication Data

US 2022/0136390 A1 May 5, 2022

(30) Foreign Application Priority Data

Mar. 6, 2019 (GB) ..... 1902978

(51) Int. Cl.
*E21D 23/14* (2006.01)
*E21D 23/00* (2006.01)
(Continued)

(52) U.S. Cl.
CPC ..... *E21D 23/144* (2016.01); *E21D 23/006* (2013.01); *E21D 23/0052* (2013.01);
(Continued)

(58) Field of Classification Search
CPC . E21D 23/144; E21D 23/0052; E21D 23/006; E21D 23/085; E21D 23/12; E21D 23/142; E21F 13/06
See application file for complete search history.

(56) References Cited

U.S. PATENT DOCUMENTS 4,887,935 A * 12/1989 Koppers ..... E21D 23/144 299/1.7
6,056,481 A * 5/2000 Watermann ..... E21D 23/16 405/294
(Continued)

FOREIGN PATENT DOCUMENTS

DE 102009048154 A1 * 4/2011 ..... E21D 23/0034
EP 2536918 A2 12/2012
(Continued)

OTHER PUBLICATIONS

International Search Report related to Application No. PCT/EP2020/025108; dated Jun. 15, 2020.
(Continued)

*Primary Examiner* — Janine M Kreck

(57) ABSTRACT

The present invention pertains to a method for monitoring operation of a mining machine unit, particularly of a long-wall mining system, having a shield unit connected to a material removing unit by means of an actuator for adjusting a distance between the shield unit and the material removing unit, the method comprises the steps of determining a position change of the shield unit during an actuating operation of the actuator; and a step of detecting a malfunction of the mining machine unit based on the determined position change.

13 Claims, 5 Drawing Sheets

(51) Int. Cl.

| | |
|---|---|
| ***E21D 23/08*** | (2006.01) |
| ***E21F 13/06*** | (2006.01) |
| ***E21D 23/12*** | (2006.01) |

(52) U.S. Cl.
CPC ..... *E21D 23/085* (2013.01); *E21D 23/12* (2013.01); *E21D 23/142* (2016.01); *E21F 13/06* (2013.01)

(56) References Cited

U.S. PATENT DOCUMENTS

| | | | | |
|---|---|---|---|---|
| 2012/0104829 | A1* | 5/2012 | Weigel | E21D 23/18 299/1.7 |
| 2016/0061036 | A1* | 3/2016 | Siegrist | E21D 23/066 340/666 |
| 2017/0019641 | A1 | 1/2017 | Rahms et al. | |

FOREIGN PATENT DOCUMENTS

| | | | |
|---|---|---|---|
| GB | 1002844 | A | 9/1965 |
| GB | 1122952 | A | 8/1968 |
| WO | 2013083185 | A1 | 6/2013 |

OTHER PUBLICATIONS

Great Britain Search Report related to Application No. 1902978.4; dated Jul. 4, 2019.

* cited by examiner

METHOD AND DEVICE FOR MONITORING OPERATION OF A MINING MACHINE UNIT

CROSS-REFERENCE TO RELATED APPLICATION

This Application is a 35 USC § 371 National Stage filing of International Application No. PCT/P2020/025108 filed on Mar. 2, 2020 which claims priority under the Paris Convention to Great Britain Patent Application No, No. 1902978.4 filed on Mar. 6, 2019.

TECHNICAL FIELD

The present invention relates to a method and a monitoring device for monitoring operation, in particular for detecting a malfunction, of a mining machine unit of a longwall mining system.

TECHNOLOGICAL BACKGROUND

Longwall mining systems are used for underground coal mining. Such systems are configured to mine coal by undercutting soil layers along a broad coal face, i.e. having a width of up to 400 m. For doing so, coal along the coal face is removed in layers upon successively advancing the longwall mining system under ground, while the roof and the overlaying layer collapse into a void generated behind the advancing longwall mining system during operation.

In order to hold off the collapsing material and thus for maintaining a safe working space along and in front of the coal face, such longwall mining systems typically comprise a plurality of powered roof supports placed in a long line side-by-side in front of the coal face. The roof supports are configured to selectively support the roof overlaying the longwall mining system and are also referred to as shield units. Further, the roof supports are usually equipped with a translationally actuatable relay bar, via which they are connected to an armoured face conveyer.

The armoured face conveyor extends along the coal face and carries a shearer unit having rotatably actuated cutting drums for cutting coal from the coal face. The shearer unit is translationally supported on the armoured face conveyor so as to drive the cutting drums back and forth along the coal face, thereby removing and disintegrating coal from the coal face which is loaded on the armoured face conveyor. The armoured face conveyer then conveys the removed coal to a side of the longwall mining system where it is further loaded onto a network of conveyor belts for transport to the surface.

In the following, the operation of such a longwall mining system is specified. At first, the longwall mining system is positioned in front of the coal face for enabling removal of coal from the coal face by means of the shearer unit. For doing so, the shearer unit is actuated and translationally moved along the whole width of the armoured face conveyor so as to remove and ablate a complete layer of coal from the coal face. During cutting operation of the shearer unit, the powered roof supports are operated in an engagement mode, in which they support or reinforce the roof above the longwall mining system.

Then, after removal of a coal layer, the armoured face conveyor together with the shearer unit is moved towards the coal face so as to bring the cutting drums of the shearer unit into engagement with the coal face again. This is performed by means of the powered roof supports. More specifically, in the engagement mode of the roof supports, the relay bars are actuated so as to protrude and thereby push the armoured face conveyer together with the shearer unit towards the coal face.

Thereafter, the roof supports are individually and successively moved to approach the armoured face conveyer. For doing so, the individual roof supports to be moved are released so as to no longer exert a supporting force against the roof. In this released state, the roof support is then pulled towards the displaced armoured face conveyor by a retracting actuation of the relay bar. In this way, individual roof supports are moved to follow up the armoured face conveyor. This is performed successively for each roof support.

As a result, by repeatedly and successively pushing the armoured face conveyer and thereafter pulling the roof supports to follow up the movement of the armoured face conveyer, the longwall mining system is enabled to advance in a feed direction.

Typically, the relay bars of the roof supports are secured to the armoured face conveyor by means of shear pins. The shear pins are configured to release the connection between the relay bars and the armoured face conveyor when mechanical forces acting on the individual shear pins exceed a predetermined value. In this way, the shear pins protect the connections and components of the longwall mining system from being subjected to excessive forces.

However, if a connection between an individual roof support and the armoured face conveyor is released, the roof support can no longer be moved or pulled in movement direction of the longwall mining system to follow up the armoured face conveyer. Accordingly, a roof support may be left behind as other roof supports advance together with the armoured face conveyor. This may lead to a critical defect of the longwall mining system. For example, in such a scenario, hydraulic connections arranged along and between the roof supports may be teared apart. Further, roof supports left behind may be damaged by the collapsing roof in the void behind the longwall mining system.

SUMMARY OF THE INVENTION

Thus, it is an objective to provide a robust method and monitoring device for detecting a malfunction of a mining machine unit, in particularly of a longwall mining system. Further, it is an objective to provide a mining machine unit for use in a longwall mining system which is equipped with such a monitoring device.

This is solved by means of a method, a monitoring device and a mining machine unit for use in a longwall mining system according to the independent claims. Preferred embodiments are set forth in the present specification, the Figures as well as the dependent claims.

Accordingly, a method is provided for monitoring operation of a mining machine unit, particularly of a longwall mining system. The mining machine unit to be monitored comprises a shield unit connected to a material removing unit by means of an actuator for adjusting a distance between the shield unit and the material removing unit. The method comprises the steps of determining a position change of the shield unit during an actuating operation of the actuator and of detecting a malfunction of the mining machine unit based on the determined position change.

Further, a monitoring device for monitoring operation of a mining machine unit is provided. The mining machine unit comprises a shield unit connected to a material removing unit by means of an actuator which is configured for adjusting a distance between the shield unit and the material removing unit. Specifically, the monitoring device comprises a sensor unit for determining a position change of the shield unit during an actuating operation of the actuator and a detection unit for detecting a malfunction of the mining machine unit based on the determined position change.

To that end, a mining machine unit for use in a longwall mining system is provided which is equipped with the above described monitoring device.

BRIEF DESCRIPTION OF THE DRAWINGS

The present disclosure will be more readily appreciated by reference to the following detailed description when being considered in connection with the accompanying drawings in which.

DETAILED DESCRIPTION OF PREFERRED EMBODIMENTS

Figure 1:
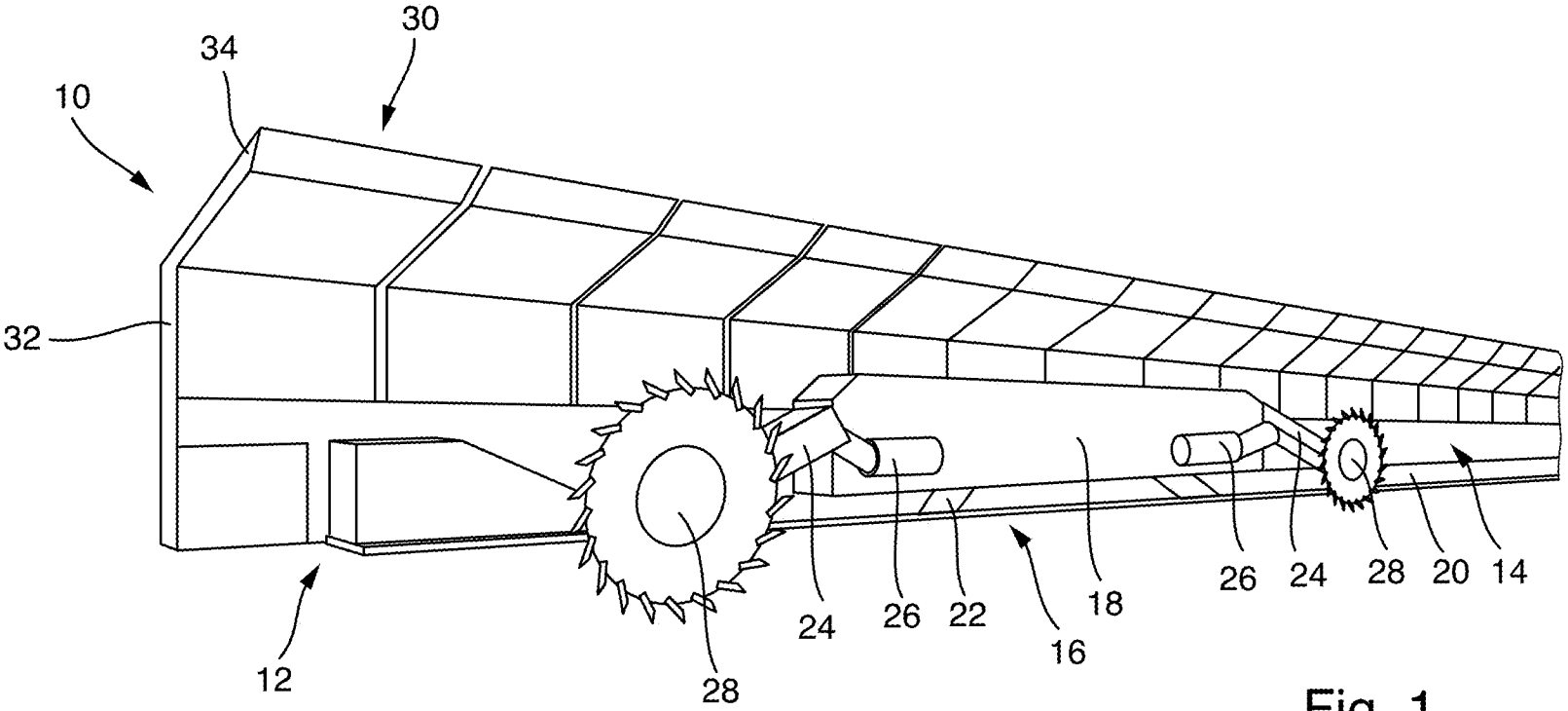
FIG. 1 schematically shows a perspective view of a longwall mining system comprising a plurality of mining machine units.

In the following, the invention will be explained in more detail with reference to the accompanying Figures. In the Figures, like elements are denoted by identical reference numerals and repeated description thereof may be omitted in order to avoid redundancies.

FIG. 1 depicts a longwall mining system 10 intended for performing underground mining, i.e. longwall mining. Specifically, the shown longwall mining system 10 may be used for coal mining, but is not limited to this application. Rather, the longwall mining system 10 may be used for mining, i.e. underground mining, of other materials.

The longwall mining system 10 comprises a material removing unit 12 configured to be placed in front of a coal face to be processed by the longwall mining system 10. Specifically, the material removing unit 12 comprises an armoured face conveyor 14 provided in the form of a long line configured for being placed along the whole width of the coal face. The material removing unit 12 further comprises a shearer unit 16 which is translationally supported on the armoured face conveyor 14.

The shearer unit 16 comprises a carriage 18 or main body engaged with a rail system 20 of the armoured face conveyor 14 by means of a tractive motive unit 22 configured to drive the shearer unit 16 along the rail system 20. By this configuration, the shearer unit 16 is configured to move along the armoured face conveyor 14 and thus along the coal face.

At opposing ends of the carriage 18, the shearer unit 16 is provided with ranging arms 24 configure to be moved up and down by means of hydraulic rams 26. Each one of the ranging arms 24 carries a shearer cutting drum 28, the circumferential surface of which is fitted with a plurality of cutting picks. The shearer cutting drums 28 are rotationally driven and configured to remove and disintegrate coal when being feed along the coal face.

The armoured face conveyor 14 is configured to receive coal removed from the coal face during cutting operation of the shearer unit 16 and to convey the removed coal to a side of the longwall mining system 10 where it may be loaded onto a network of conveyor belts for transport to the surface.

The longwall mining system 10 further comprises a plurality of mining machine units 30 which are placed in a long line side-by-side behind and along the armoured face conveyer 14. In this context, the term "behind" refers to a movement or feed direction of the longwall mining system 10.

Each mining machine unit 30 comprises a shield unit 32, also referred to as a roof support, a chock or a jack unit. The shield unit 32 is configured to selectively support the roof overlaying the longwall mining system 10 when being operated under ground. For doing so, the shield unit 32 comprises a hydraulically actuated shield 34 which can be moved up and down.

The shield unit 32 is configured to be operated in an engagement operating mode, in which the shield 34 supports the roof overlaying the shield unit 32. In the engagement mode, the shield 34 is moved upwards. Further, the shield unit 32 can be operated in a release operating mode, in which the shield 34 is moved downwards compared to its engagement operating mode.

Figure 2:
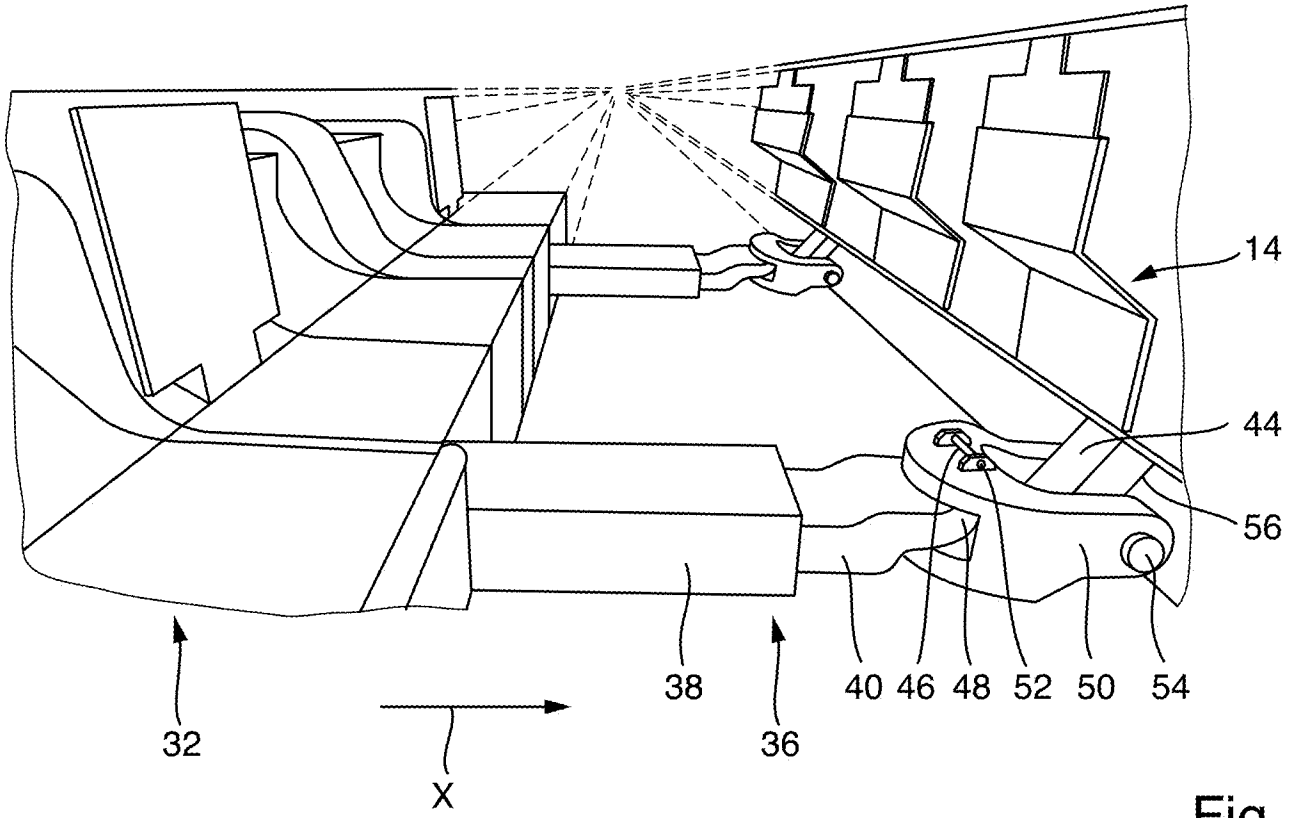
FIG. 2 schematically shows a perspective view of a connection between the mining machine units and a material removing device of the longwall mining system depicted in FIG. 1.

As can be gathered from FIG. 2, each shield unit 32 is connected to the material removing unit 12 by means of an actuator 36. Each actuator 36 is configured for adjusting a distance between the corresponding shield unit 32 and the material removing unit 12.

Specifically, the actuator 36 is a linear actuator provided in the form of a telescopic actuator comprising a cylinder 38 and a piston 40, also referred to as a relay bar or ram. The actuator 36 is provided such that, upon its actuation, the piston 40 is moved, i.e. retracted or protruded, relative to the cylinder 38 along a feed direction X of the longwall mining system 10.

In the shown configuration, each actuator 36 is arranged such that the cylinder 38 is directly secured to a main body of the corresponding shield unit 32 and the piston 40 is directly secured to the armoured face conveyor 14. Alternatively, the actuator 36 may be provided such that the piston 40 is directly secured to the main body of the shield unit 32 and the cylinder 38 as directly secured to the armoured face conveyor 14. Each actuator 36 is associated and connected to individual sections of the armoured face conveyer 14. These sections are also referred to as pans 44.

The piston 40 of each actuator 36 is secured to the corresponding pan 44 of the armoured face conveyer 14 by means of a shear pin 46. Specifically, each pan 44 of the armoured face conveyer 14 is provided with a clevis hinge 50, to which a head portion 48 of the piston 40 is secured by means of the shear pin 46. As can be gathered from FIG. 2, each clevis hinge 50 comprises a recess for accommodating the head portion 48 of the corresponding piston 40, wherein the shear pin 46 vertically extends through both the clevis hinge 50 and the head portion 48 of the piston 40. For securing the shear pins 46 in their engagement position with the clevis hinge 50 and the piston 40, safety pins 52 are provided.

The shear pins 46 are configured to break and thus to release a connection between an actuator 36 and the material removing unit 12 when mechanical forces acting on the shear pin 46 exceed a predetermined value. In this way, the shear pins 46 form a predetermined breaking point for protecting the mining machine units 30 and the material removing unit 12 from being subjected to excessive loads which may cause irreparable damage of the longwall mining system.

The clevis hinges 50 are connected to the respective pans 44 of the armoured face conveyer 14 by means of a bolt connection allowing vertical movement of the clevis hinge 50 relative to the pan 44. The bolt connection comprises a bolt 54 firmly fixed to the clevis hinge 50 which is received in a slotted hole 56 provided in the pan 44. By such a configuration, the connection between the actuator 36 and the material removing unit 12 allows for rotational movement around an axis perpendicular to the feed direction X.

Figure 3:
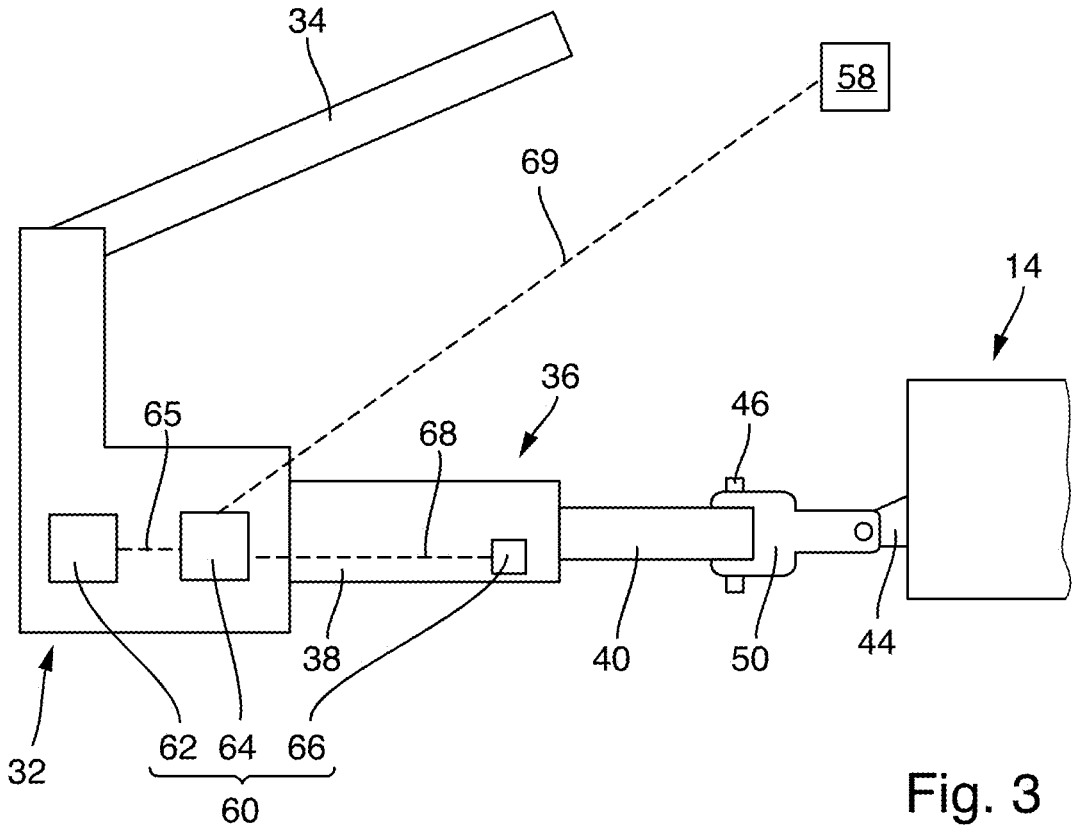
FIG. 3 schematically shows a side view of a mining machine unit depicted in FIGS. 1 and 2 which is equipped with a monitoring device for monitoring operation of the mining machine unit.

Furthermore, as depicted in FIG. 3, the longwall mining system 10 comprises a central control unit 58 for controlling operation of the individual mining machine units 30. Specifically, the central control unit 58 is configured to selectively actuate the shield units 32 and the actuators 36 of the plurality of mining machine units 30 so as to control forward movement of the longwall mining system 10 along the feed direction X. For doing so, the central control unit 58 is configured to selectively operate the actuators 36 in a retracting operating mode, in which the piston is retracted relative to the cylinder 38, and in a protruding operating mode, in which the piston 38 is protruded relative to the cylinder 38. Further, the central control unit 58 is configured to selectively operate the shield units 32 in the engagement operating mode, in which the respective shields 34 are moved upwards to engage with and to support the roof overlaying the respective mining machine units 30, and in the release operating mode, in which the respective shields 34 are moved downwards. Accordingly, in the released operating mode, the shield units 32 are not engaged with and thus do not support the roof overlaying the respective mining machine units 30.

In this way, the central control unit 58 is enabled to control forward movement of the longwall mining system 10. Specifically, for moving the material removing unit 12 forward, i.e. in direction of and towards the coal face, the central control unit 58, at first, operators the shield units 32 of the plurality of mining machine units 30 into its engagement operating mode such that the shields 34 occupy their engagement position in which they are engaged with and thus support the roof overlaying the longwall mining system 10. Then, the actuators 36 of the plurality of mining machine units 30 are operated in their protruding operating mode so as to push the material removing unit 12 in the feed direction X of the longwall mining system 10. Thereafter, the central control unit 58 successively moves individual mining machine units 30 to follow up the movement of the material removing unit 12. For doing so, the central control unit 58, at first, operates the shield unit 32 of an individual mining machine unit 30 in its release operating mode, thereby moving its shield 34 downwards so as to no longer engage with the roof overlaying the mining machine unit 30. Thereafter, the actuator 36 of the same mining machine unit 30 is operated in its retracting operating mode, thereby pulling the shield unit 32 towards the displaced material removing unit 12 so as to follow-up the movement thereof. This pulling operation is successfully performed for each one of the plurality of mining machine units 30. In this way, feed movement of the longwall mining system 10 may be performed successively.

Furthermore, for monitoring operation of the longwall mining system 10, each one of the plurality of mining machine units 30 is equipped with a monitoring device 60. The monitoring device 60 is configured for monitoring operation of its corresponding mining machine unit 30, i.e. for detecting a malfunction of the mining machine unit 30. In other words, the monitoring device 60 is configured to detect whether the corresponding mining machine unit 30, i.e. its connection to the material removing unit 12, is in a proper condition or in a failure condition.

In the context of the present disclosure, the term "proper condition" refers to a condition of a mining machine unit 30 which ensures proper operation of the longwall mining system 10. Accordingly, the term "malfunction" or "failure condition" refers to a condition of a mining machine unit 30 that indicates that proper operation of the longwall mining system 10 cannot be ensured. Rather, upon further operation of the longwall mining system 10 while one or more mining machine units 30 are affected by a malfunction, damages of the longwall mining system's components, i.e. the mining machine units 30, are to be expected.

In the shown configuration, each one of the plurality of mining machine units 30 is equipped with a monitoring device 60, respectively. In an alternative embodiment, a common monitoring device 60 may be used for monitoring operation of the plurality of mining machine units 30. In such a configuration, at least a part of the monitoring device 60 may be constituted by the central control unit 58.

Figure 4:
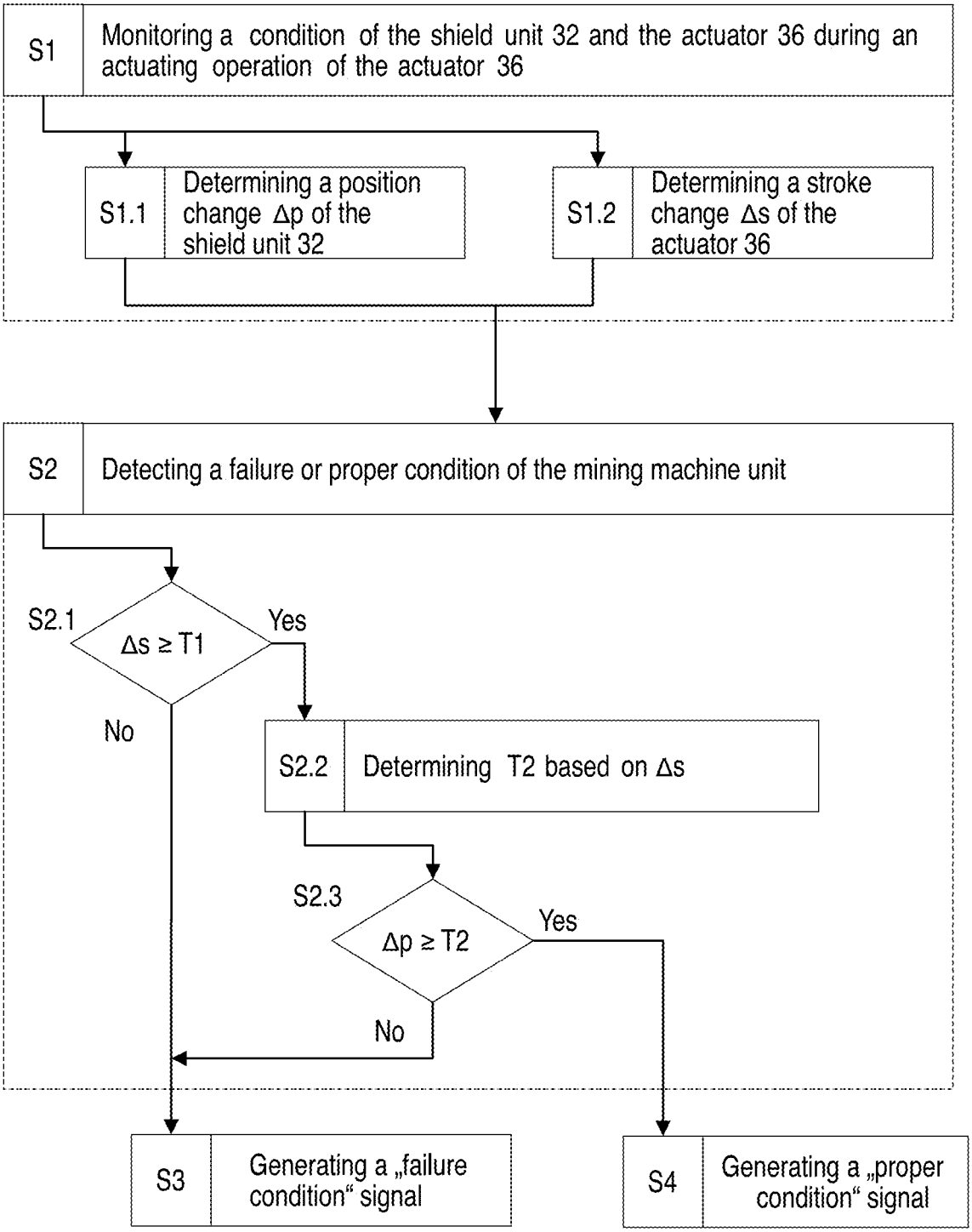
FIG. 4 shows a flow diagram illustrating a method performed by the monitoring device depicted in FIG. 3 for monitoring operation of the mining machine unit.

Under reference of FIG. 4, a method for monitoring operation of a mining machine unit 30 is specified which is performed by one of the above described monitoring devices 60. The method is exemplary described in connection with one of the plurality of monitoring devices 60 and, accordingly, may be applied by each one of the other monitoring devices 60 of the longwall mining system 10.

In a first step S1 of the method, a condition change of the shield unit 32 and the actuator 36 is monitored during an actuating operation of the actuator 36. The actuating operation, in general, refers to an actuation of the actuator 36 for decreasing the distance between the corresponding shield unit 32 and the material removing unit 12. In other words, the actuating operation refers to an operation of the actuator 36 for pulling the shield unit 32 towards the material removing unit 12, i.e. for enabling the shield unit 32 to follow up an advancing movement of the material removing unit 12 as described above. In the shown configuration, the actuating operation is a retracting operation and thus corresponds to an operation of the actuator 36 in the retracting operating mode.

Specifically, the first step S1 comprises two sub steps which may be performed simultaneously or successively. In a first sub step S1.1, a position change $\Delta p$ of the shield unit 32 is determined during the actuating operation of the actuator 36. Specifically, the position change $\Delta p$ refers to a parameter which is indicative of a displacement, i.e. a displacement length, the shield unit 32 is or has been subjected to during the actuating operation of the actuator 36. In other words, the position change $\Delta p$ is indicative of a displacement, i.e. a displacement length, of the shield unit 32 with respect to an initial position. More specifically, the position change $\Delta p$ is indicative of a distance between an end position and an initial position of the shield unit 32 during the actuating operation. In this context, the term "initial position" refers to a position of the shield unit 32 at the beginning of the actuating operation or before the actuator 36 is operated in the actuating operation. The term "end position" refers to a position of the shield unit 32 at the end or after the actuating operation of the actuator 36. More specifically, the position change is indicative of a change of the shield unit's position along a direction pointing towards the material removing unit 12, i.e. which coincides with the feed direction X of the long wall mining system 10.

For determining the position change Δp, the monitoring device 60 comprises a detection unit 64, i.e. in the form of a control unit, which is communicatively connected to a position change sensor 62. The detection unit 64 is configured to receive measurement signals from the position change sensor 62 via a first signal line 65, based on which it determines the position change Δp. In an alternative configuration, the detection unit 64 and the position change sensor 62 may be wirelessly connected.

In the shown configuration, the position change sensor 62 is provided in the form of an acceleration sensor, also referred to as accelerometer or motion sensor. The position change sensor 62 is comprised in the shield unit 32 and configured to measure acceleration experienced by the shield unit 32. Specifically, the position change sensor 62 is configured to measure acceleration at least along the feed direction X, i.e. pointing from a center of gravity of the shield unit 32 towards the material removing unit 12. Accordingly, the measured signal generated by the position change sensor 62 thus indicates a magnitude of an acceleration of the shield unit 32 along the feed direction X.

Figure 5:
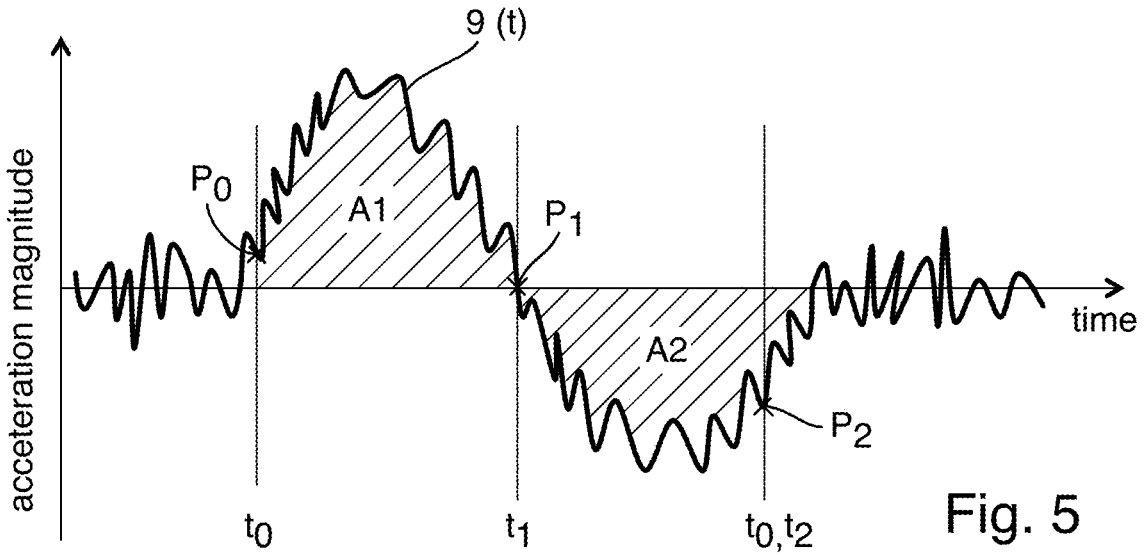
FIG. 5 shows a diagram illustrating a measured signal obtained by a sensor unit of the monitoring device depicted in FIG. 3.

FIG. 5 depicts a diagram which exemplary illustrates a measurement signal generated by the position change sensor 62 during the actuating operation. In the diagram, the acceleration magnitude is illustrated as a function of time and provided in the form of a curve g(t). The abscissa of the diagram depicts acceleration magnitude along the feed direction X, wherein a positive magnitude indicates acceleration of the shield unit 62 towards the material removing unit 12. The ordinate of the diagram depicts the time, wherein $t_0$ indicates the beginning and $t_a$ indicates the end of the actuating operation. Accordingly, the time period extending from $t_0$ to $t_a$ indicates the duration of the actuating operation.

The thus generated measurement signal is received by the detection unit 64 via the first signal line 65 and processed so as to determine the position change parameter Δp. Specifically, the detection unit 64 is configured to derive or calculate at least one area $A_j$ under the curve g(t) and to determine the position change Δp based on the derived area $A_j$.

More specifically, the detection unit 64 is configured to, at first, calculate zero-crossing points $P_j$ of the signal or curve g(t) during the actuating operation, i.e. between $t_0$ and $t_a$, at which the measured acceleration equals zero. It is pointed out that points of the signal at the beginning, i.e. at time $t_0$, and at the end, i.e. at time $t_a$, of the actuating operation are also considered as zero-crossing points $P_j$. Then, the detection unit 64 derives an absolute value of all areas $A_j$ under the curve g(t). This is performed by successively calculating an absolute value of an integral of the measurement signal between two subsequent zero-crossing points $P_j$. These absolute values are then sum for determining the position change Δp. Thus, the position change parameter Δp determined by the detection unit 64 may be expressed as follows:

$$\Delta p = \sum_{i=1}^{j-1} \left| \int_{t_{Pi-1}}^{t_{Pi}} g(t)dt \right|, \tag{1}$$

wherein j indicates the total number of zero-crossing points determined during the actuating operation, including points at time $t_0$ and $t_a$; and $t_{Pi}$ indicates the time, i.e. abscissa value, of the zero-crossing point $P_i$.

Alternatively or additionally, the detection unit 64 may be configured to compare a part of the measured signal obtained during the actuating operation with another part of the measured signal obtained before or after the actuating operation. Based on this comparison, the detection unit 64 may detect whether the shield unit 32 has been properly moved during the actuating operation, thereby deciding whether the proper condition or the failure condition of the mining machine unit 30 is present.

Alternatively or additionally, the detection unit 64 may be configured to further take into account at least one further measured signal obtained by further position change sensors, i.e. acceleration sensors, associated to at least one further mining machine unit being arranged adjacent to the mining machine unit 30 incorporating the detection unit 64. Based thereupon, the measured signal obtained by the position change sensor 62 may be subjected to noise suppression. In this way, a part of the measured signal may be extract which is associated to the movement or acceleration of the shield unit 32 caused by the actuating operation of the actuator 36.

As set forth above, the shown monitoring device 60 makes use of an acceleration sensor. Such a device measures proper acceleration of the shield unit 32. In other words, the acceleration sensor measures an acceleration of the shield unit 32 relative to itself, e.g. relative to its initial position.

However, the monitoring device 60 is not limited thereto. Rather, any sensor unit may be used as a position change sensor 62 which is suitable to measure or determine a parameter indicative of a position change of the shield unit 32.

For example, in an alternative embodiment, the position change sensor 62 may be configured to determine the position change relative to at least one of the material removing unit 12, a further mining machine unit connected adjacent to the mining machine unit 30 being equipped with the monitoring device 60 and a surrounding of the mining machine unit 30.

This may be realized by means of a sensor unit that determines a distance between two points, i.e. a sender point and a receiver point, based on runtime or travel-time measurements of a signal being transmitted between the two points. In other words, such a sensor unit determines a distance between the two points. For example, such a sensor unit may be configured to determine or measure the time required by a signal to be transmitted from a sender to a receiver. This time is also referred to as one-way delay. Alternatively, the sensor unit may be configured the determined the time required by the signal to be transmitted from the sender to the receiver and from the receiver back to the sender. This time is also referred to as end-to-end delay. The shield unit 32 may be equipped with the sender and at least one of the material removing unit 12, a further mining machine unit connected adjacent to the mining machine unit 30 being equipped with the monitoring device 60 and a surrounding of the mining machine unit 30 may be equipped with the receiver, or vice versa.

Such a sensor unit may use an electromagnetic signal to be detected. For example, the sensor unit may be an optical sensor unit that emits light, e.g. a laser beam, and detects the reflected light. Alternatively, the sensor unit may use radio waves as the signal to be transmitted and detected. Accordingly, the sensor unit may be a wireless sensor unit device, such as a Wi-Fi or Bluetooth sensor device.

Furthermore, the sensor unit may be provided in the form of an odometer which is configured to determine the position change of the shield unit 32 relative to its surrounding, i.e. in particular the ground carrying the mining machine unit 30. For example, the shield unit 32 may be provided with at least one measuring wheel arranged at its bottom which is actuated upon movement of the shield unit 32. By measuring the movement of the measuring wheel, the odometer is capable of determining the position change of the shield unit 32.

Step S1 further comprises a second sub step S1.2 of determining a stroke change of the actuator 36 during its actuating operation. Specifically, the stroke change Δs refers to a parameter which indicates a stroke change length, the piston 40 of the actuator 36 is subjected or has been subjected to during its actuating operation. In other words, the stroke change Δs indicates a displacement, i.e. a displacement length, of the piston 40 with respect to an initial position thereof. Accordingly, the stroke change Δs indicates a displacement between an end position and an initial position of the piston 40 during the actuating operation. In this context, the term "initial position" refers to a position of the piston 40 at the beginning of or before the operating operation, wherein the term "end position" refers to a position of the piston 40 at the end or after the actuating operation.

For determining the stroke change Δs, the monitoring device 60 is provided with a displacement sensor 66 configured to determine the stroke change. The displacement sensor 66, for example, may be a reed sensor or any other suitable sensor capable of determining a stroke or stroke change Δs of the actuator 36, i.e. its piston 40. As can be gathered from FIG. 3, the displacement sensor 66 is comprised in the actuator 36, i.e. its cylinder 38. The displacement sensor 66 is connected to the detection unit 64 by means of a second signal line 68, via which it transmits the determined stroke change Δs to the detection unit 64. Alternatively, the displacement sensor 66 may transmit the determined stroke change Δs wirelessly to the detection unit 64.

In a second step S2 of the method, the operation of the mining machine unit 30 is monitored. This step is performed by means of the detection unit 64 and based on the determined position change Δp obtained in the sub step S1.1 and based on the determined stroke change Δs obtained in the sub step S1.2. More specifically, in the second step S2, the detection unit 64 of the monitoring device 60 determines based on the determined position and stroke change whether or not the mining machine unit 30, i.e. its connection to the material removing 12, is affected by a malfunction. In other words, the detection unit 64 detects whether the corresponding mining machine unit 30, i.e. its connection to the material removing unit 12, is in the failure condition or in the proper condition.

In general, the detecting unit 64 is configured to detect the malfunction or the failure condition of the mining machine unit 30 when the determined position change does not indicate a proper change of the shield unit's position during the actuating operation. Further, the detection unit 64 is configured to detect the proper condition of the mining machine unit 30 when the determined position change indicates a proper change of the shield unit's position.

For determining whether or not the determined position change Δp indicates a proper or adequate change of the shield unit's position, the detection unit 64 is configured to compare the determined position change with a threshold. For example, the detection unit 64 may detect the failure condition when the determined position change Δp does not exceed a threshold and to detect the proper condition when the determined position change Δp is equal to or exceeds the threshold.

To that end, for determining whether or not the determined position change Δp indicates a proper or adequate change of the shield unit's position, the detection unit 64 is configured determine whether the determined position change and stroke change correlate. In other words, for determining a proper change of the shield unit's position, the detection unit 64 further takes into account the determined stroke change. Specifically, the detection unit 64 is configured to determine the proper condition of the mining machine unit 30 when the determined position change Δp and the determined stroke change Δs correlate and to determine the failure condition when the determined position change Δp and the determined stroke change Δs do not correlate.

More specifically, for deciding whether the determined position Δp change in the determined stroke change Δs correlate, the detection unit 64 is configured to compare each one of the determined values with a corresponding threshold as depicted in FIG. 4 by sub steps S.2.1 and S2.3.

In a first sub step 2.1, the detection unit 64 is configured to compare the absolute value of the determined stroke change Δs to a first threshold T1. If the absolute value of determined stroke change Δs is equal to or is greater than the first threshold T1, the detection unit 64 proceeds to a second sub step S2.2 as depicted in FIG. 4. However, if the absolute value of the determined stroke change is lower than the first threshold T1, the detection unit 64 proceeds to a third step S3 of the method, in which the detection unit 64 outputs a failure condition signal which is transmitted to the central control unit 58, i.e. via a third signal line 69 or wirelessly. The failure condition signal indicates to the central control unit 58 that the mining machine unit 30 under consideration is affected by a malfunction.

In the second sub step S2.2, the detection unit 64 calculates a second threshold T2 based on the determined stroke change Δs. Thereafter, in the third sub step S2.3, the detection unit 64 compares the determined position change Δp to the second threshold T2. If the detection unit 64 determines that an absolute value of the determined position change Δp is lower than the second threshold T2, the detection unit 64 proceeds to the third step S3 and outputs the failure condition signal to the central control unit 58. If the detection unit 64 in sub step S2.3, however, determines that the absolute value of the determined position change Δp is equal to or greater than the second threshold T2, the detection unit 64 proceeds to a fourth step S4, in which the detection unit 64 outputs a proper condition signal which is transmitted to the central control unit 58, i.e. via the third signal line 69 or wirelessly. The proper condition signal indicates to the central control unit 58 that the mining machine unit 30 under consideration is in the proper condition.

Figure 6:
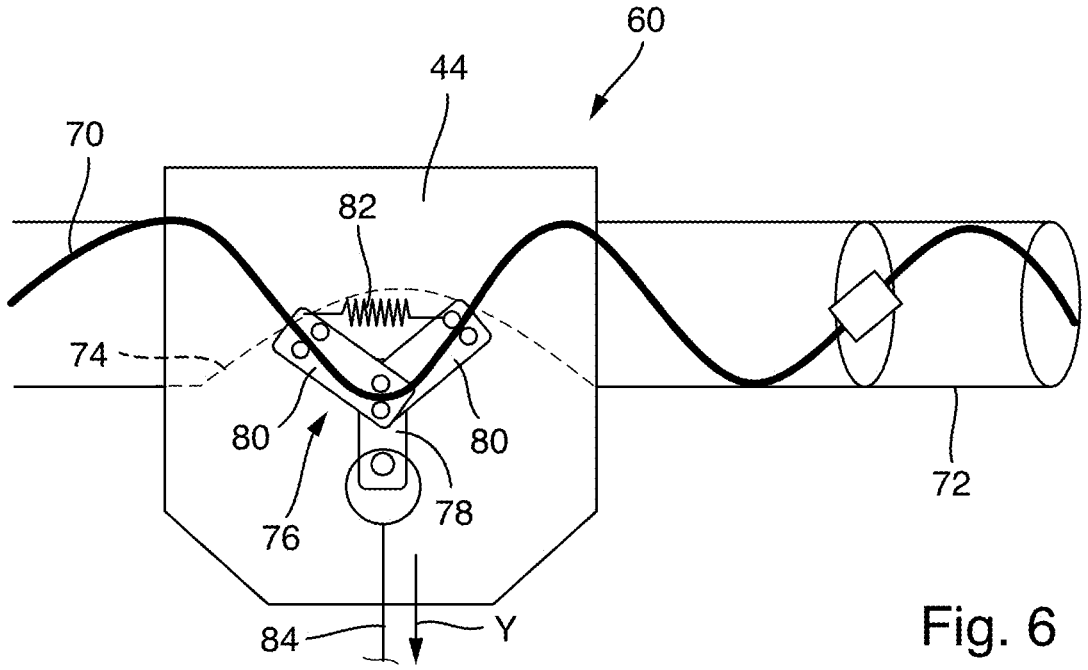
FIG. 6 schematically shows a bottom view of a connection between a mining machine unit and the material removing unit which is equipped with a monitoring device according to another embodiment.

Under reference of FIG. 6, another configuration of a monitoring device 60 is specified. According to this configuration, the monitoring device 60 is provided in the form of a passive monitoring device fitted to the plurality of pans 44 of the armoured face conveyer 14 as depicted in FIG. 6.

Specifically, the monitoring device 60 makes use of time domain reflectometry (TDR). In general, TDR involves sending a pulse of energy through a transport medium and measuring the reflections and the characteristics of the medium change. In this way, changes or faults in transmission lines, i.e. the transport medium, may be detected and located. Alternatively, the monitoring device 60 may use variations of TDR, such as frequency domain reflectometry or spread spectrum techniques.

Specifically, the monitoring device 60 comprises a transport medium 70 that is fixed to the armoured face conveyer 14 so as to extend along the plurality of pans 44, i.e. along the pan line. In the configuration shown in FIG. 6, the transport medium 70 is a fiber optical cable attached to the plurality of pans 44 on an underside thereof. For protecting the transport medium 70, a hose 72 is provided for receiving and accommodating the transport medium 70. Inside the hose 72, the transport medium 70 is loosely spiraled.

At each pan 44, the hose 72 is provided with a recess or hose cut-out 74 for exposing the transport medium 70. To the exposed section of the transport medium 70, a mechanical link 76 is fitted which is configured to manipulate a signal transmitting characteristic of the transport medium 70 based on a mechanical force acting on a pull cord retainer 78.

In the shown configuration, the mechanical link 76 comprises two lever arms 80 which are rotatably fixed to one another at a first end. To the first end of the lever arms 80, the pull cord retainer 78 is attached. The mechanical link 76 is provided such that, upon pulling the pull cord retainer 78 in a direction Y pointing away from the lever arms 80, second ends of the lever arms 80, which are arranged opposed to the first end, approach to one another. Further, a spring element 82 is arranged between the second ends of the lever arms 80 which biases the second ends together.

The transport medium 70 is attached to the mechanical link 76 such that the transport medium 70 is successively secured to the second end of a first one of the two lever arms 80, to the first end of the same lever arm 80, and to the second end of the other one of the two lever arms 80, as can be gathered from FIG. 6. By such a configuration, a bending radius of the transport medium 70 and thus the signal transmitting characteristic thereof can be changed upon actuation of the mechanical link 76, i.e. the pull cord retainer 78. Accordingly, when no pulling force is exerted onto the pull cord retainer 78, the transport medium 70 is subjected to a maximum bending radius which impairs the signal transmitting characteristic of the transport medium 70.

The pull cord retainer 78 of the mechanical link 76 is connected to the cylinder 38 of the actuator 36 by means of a cord line 84, i.e. made of steel. The cord line 84 extends on an underside of the actuator 36 so as to be protected from falling material. The connection between the cord line 84 and the pull cord retainer 78 is provided such that, when a connection between the actuator 36, i.e. its piston 40, and the armoured face conveyer 14, i.e. its pan 44, is released, also the connection between the cord line 84 and the pull cord retainer 78 is released. Thus, upon releasing the connection between the actuator 36 and the armoured face conveyer 14, a maximum bending radius of the transport medium 70 is set, thereby impairing its signal transmitting characteristic.

The monitoring device 60 further comprises a sensor unit (not shown) for determining the signal transmitting characteristic of the transport medium and thus for determining a position change of the shield unit 32 during actuating operation of the actuator 36. Specifically, the sensor unit is provided in the form of a TDR sensor head attached to one end of the transport medium 70 at a side end of the pan line. The sensor unit comprises a pulse generator for generating a pulse of energy which is transmitted through the transport medium 70. Further, the sensor unit comprises a sensor for measuring reflections of the energy pulse, based on which the signal transmitting characteristic of the transport medium 70 is determined. These measured reflections are indicative of a position change of the shield units 32.

The measured reflections are transmitted to a detection unit (not shown) of the monitoring device 60 which is configured to determine, based on the measured reflections, whether or not the transport medium 70 comprises bad signal transmitting characteristics and at which position, at which length, of the transport medium 70 these characteristics occur. In this way, the detection unit is configured to determine at which pan 44 of the armoured face conveyer 14 the mechanical link 76 is released, thereby indicating which mining machine unit 30 is released from the armoured face conveyer 14 and thus is affected by a malfunction. The sensor unit is configured to continuously analyze the line characteristic of the transport medium 70 from sensor head to line termination.

A monitoring device 60 making use of TDR is regarded a passive monitoring device, as no energy storing devices or active components are required in the pan line. All electronics can be disposed in an electric compartment arranged at the side end of the pan line.

In an alternative embodiment, the transport medium 70 may be provided in the form of an electrical cable, i.e. a copper cable. Accordingly, the mechanical link 76 may be provided in the form of an electrical switch which, in a released state, interrupts an electrical connection of the transport medium 70.

It will be obvious for a person skilled in the art that these embodiments and items only depict examples of a plurality of possibilities. Hence, the embodiments shown here should not be understood to form a limitation of these features and configurations. Any possible combination and configuration of the described features can be chosen according to the scope of the invention.

A method may be provided for monitoring operation of a mining machine unit, particularly of a longwall mining system. The mining machine unit to be monitored may comprise a shield unit connected to a material removing unit by means of an actuator for adjusting a distance between the shield unit and the material removing unit. The method may comprise the steps of determining a position change of the shield unit during an actuating operation of the actuator and of detecting a malfunction of the mining machine unit based on the determined position change.

Typically, in such a mining machine unit, the actuator is connected to at least one of the shield unit or the material removing unit by means of a shear pin. The shear pin may be configured to release the connection between the mining machine unit and the armoured face conveyor when mechanical forces acting on the individual shear pin exceed a predetermined value. In this way, the shear pin may form a predetermined breaking point for protecting the mining machine unit from being subjected to excessive loads which may cause irreparable damage.

The malfunction condition of the mining machine unit may be caused due to a broken shear pin. In the proposed method, the malfunction or failure condition of the mining machine unit is detected based on the determined position change during the actuating operation of the actuator. In this way, the proposed method enables to avoid that a condition of the shear pin is directly monitored during operation. Such measures, i.e. for directly monitoring the condition of the shear pin, would require a sensor unit being arranged on an outer surface of the mining machine unit, i.e. the actuator. However, due to the mechanical strong environmental conditions during operation of the mining machine unit, such a sensor unit would be exerted to excessive mechanical forces and would therefore require a robust and costly design.

Thus, by detecting the malfunction of the mining machine unit based on a position change of the shield unit, a robust method may be provided that, in addition, may be cost-effectively implemented.

The proposed method may be used in or for longwall mining systems comprising a plurality of mining machine units. However, the method is not limited to this application and may be used in connection with any mining or material removing system which comprises at least one mining machine unit as described above.

In the mining machine unit, the actuator may be configured for adjusting the distance between the shield unit and the material removing unit. As set forth above, a position change of the shield unit is determined during an actuating operation of the actuator. This actuating operation may refer to an operation of the actuator for decreasing a distance between the shield unit and the material removing unit. Alternatively, the actuating operation may refer to an operation of the actuator for increasing the distance between the shield unit and the material removing unit. The actuator may be a linear actuator. Accordingly, the actuating operation may be a retracting operation of the actuator or a protruding operation of the actuator. The actuator may comprise a cylinder and a piston received in the cylinder, wherein upon actuation of the actuator, the piston is moved, i.e. retracted or protruded, relative to the cylinder.

As set forth above, during the actuating operation, the step of determining the position change is performed. Specifically, the position change may be a parameter indicative of or indicating a distance, i.e. a displacement length, of the shield unit, in particular with respect to an initial position of the shield unit. In other words, the position change may be indicative or indicate a displacement of the shield unit with respect to a position of the shield unit at the beginning of the actuating operation. More specifically, the position change may be indicative of or indicate a change of the shield unit's position at least along a direction pointing towards the material removing unit. The direction may coincide with a feed direction of the mining machine unit or the longwall mining system.

For determining the position change, a position change sensor may be used. For example, the position change sensor may be configured to determine a change of the shield unit's position relative to itself, i.e. relative to the initial position. For doing so, the position change sensor may be an acceleration sensor, also referred to as motion sensor or accelerometer. In other words, the position change may be determined by means of an acceleration sensor.

The acceleration sensor may be comprised in the shield unit. By making use of such a position change sensor, it may be avoided that measurement units required for monitoring operation of the mining machine unit, i.e. for detecting a failure or proper condition thereof, are attached to an outer surface the mining machine unit. Accordingly, the proposed solution allows that components required for performing the proposed method are prevented from being exposed to excessive mechanical loads. In this way, robustness of a device for performing the method and thus of the method itself may be ensured.

However, the position change sensor is not limited thereto. Rather, any sensor unit suitable to measure or determine a parameter indicative of a position change of the shield unit may be used as a position change sensor.

For example, in an alternative embodiment, the position change sensor may be configured to determine the position change relative to at least one of the material removing unit, a further mining machine unit being arranged adjacent to the mining machine unit and a surrounding of the mining machine unit, in particular a ground carrying the mining machine unit.

This may be realized by means of a sensor unit that determines a distance between two points, i.e. a sender point and a receiver point, based on runtime or travel-time measurements of a signal being transmitted between the two points. The sensor unit may comprise a sender disposed in or on at least one of the shield unit and the actuator and a receiver or transmitter disposed in or on the material removing unit, or vice versa.

Such a sensor unit may use an electromagnetic signal as the signal to be transmitted and detected. For example, the sensor unit may be an optical sensor unit that emits light, e.g. a laser beam, and detects the reflected light. Alternatively, the sensor unit may use radio waves as the signal to be transmitted and detected. Accordingly, the sensor unit may be a wireless sensor unit device, such as a Wi-Fi or Bluetooth sensor device.

In a further step of the method, as set forth above, a malfunction or failure condition of the mining machine unit is detected based on the determined position change. This step may be performed such that the failure condition of the mining machine unit is detected when the determined position change does not indicate a proper change of the shield unit's position during the actuating operation and to detect to proper condition of the mining machine unit when the determined position change indicates a proper change of the shield unit's position.

For determining whether or not the determined position change indicates a proper or adequate change of the shield unit's position, the determined position change may be compared to a threshold. For example, in the step of detecting a malfunction, the failure condition of the mining machine unit may be detected when the determined position change does not exceed the threshold, and wherein a proper condition of the mining machine unit may be detected when the determined position change is equal to or exceeds the threshold.

In the method, the threshold may be determined in dependence on the actuating operation of the actuator. For example, the threshold may be determined based on a duration of the actuating operation. Alternatively, the threshold may be determined based on a stroke change of the actuator, i.e. during the actuating operation.

The method may further comprise a step of determining a stroke change of the actuator during its actuating operation. Further, the step of detecting a malfunction of the mining machine unit may be performed based on the determined stroke change. In other words, in the step of detecting a malfunction of the mining machine unit, the malfunction of the mining machine unit is detected based on the determined position change and the determined stroke change.

Specifically, the stroke change may refer to a parameter which is indicative of or indicates a stroke change length, in particular with respect to an initial stroke of the actuator prior to being operated in its actuating operation. In other words, the stroke change may be indicative of or indicate a displacement, i.e. a displacement length, of the piston relative to the cylinder during actuating operation.

In a further development, in the step of detecting a malfunction, the failure condition of the mining machine unit may be detected when the determined stroke change and the determined position change do not correlate, and wherein the proper condition of the mining machine unit may be detected when the determined stroke change and the determined position change correlate.

For example, for deciding whether the determined position change and the determined stroke change correlate, each of the determined position and stroke change may be compared to a threshold, respectively. Accordingly, in the step of detecting a malfunction, the failure condition may be detected when an absolute value of the determined stroke change is greater than a first threshold or when an absolute value of the determined position change is lower than a second threshold. Further, the proper condition may be detected when an absolute value of the determined stroke change is equal to or greater than the first threshold and an absolute value of the determined position change is equal to or greater than the second threshold.

In a further development, the second threshold may be determined based on the determined stroke change. In this way, the second threshold may be dynamically adapted.

In the following, the structural configuration of the actuator of the mining machine unit is specified. Specifically, the actuator may be connected to at least one of the shield unit and the material removing unit by means of a shear pin. The shear pin may be configured to release a connection between the actuator and the at least one of the shield unit and material removing unit when a mechanical force acting on the shear pin exceeds a predetermined value. Further, the actuator may be a linear actuator, in particular a telescopic actuator comprising the cylinder secured to the shield unit and the piston secured to the material removing unit, or vice versa. In other words, the cylinder may be arranged on a shield unit's side and the piston may be arranged on a material removing unit side of the actuator. Alternatively, the piston may be arranged on a shield unit's side and the cylinder may be arranged on a material removing unit side of the actuator.

Further, a monitoring device for monitoring operation of a mining machine unit may be provided. The mining machine unit may comprise a shield unit connected to a material removing unit by means of an actuator which is configured for adjusting a distance between the shield unit and the material removing unit. Specifically, the monitoring device may comprise a sensor unit for determining a position change of the shield unit during an actuating operation of the actuator and a detection unit for detecting a malfunction of the mining machine unit based on the determined position change.

The monitoring device may particularly be provided for performing or executing the above described method. Accordingly, technical features which are described in connection with the above method may also relate and be applied to the proposed monitoring device, and vice versa.

As set forth above, the monitoring device may comprise a sensor unit and a detection unit. These units may refer to functional units which may be allocated to different components or to a single component. Specifically, the detection unit may be configured to perform the method as described above. Further, the sensor unit may be or comprise an acceleration sensor.

To that end, a mining machine unit for use in a longwall mining system may be provided. The mining machine unit comprises a monitoring device as described above. Accordingly, technical features which are described in connection with the monitoring device and the monitoring method may also relate and be applied to the proposed mining machine unit, and vice versa.

The invention claimed is:

1. A method for monitoring operation of a mining machine unit, particularly of a longwall mining system, having a shield unit connected to a material removing unit by an actuator for adjusting a distance between the shield unit and the material removing unit, the method comprising:

using reflectometry to determine a position change of the shield unit during an actuating operation of the actuator; and detecting a malfunction of the mining machine unit based on the determined position change.

2. The method according to claim 1, wherein the actuating operation is a retracting operation of the actuator.

3. The method according to claim 1, wherein the determined position change is indicative of a displacement length of the shield unit, in particular with respect to an initial position of the shield unit.

4. The method according to claim 1, wherein the position change is indicative of a change of the shield unit's position along a direction (X) pointing towards the material removing unit.

5. The method according to claim 1, wherein a failure condition of the mining machine unit is detected when the determined position change does not indicate a change of the shield unit's position, and wherein a proper condition of the mining machine unit is detected when the determined position change indicates a change of the shield unit's position.

6. The method according to claim 1, the failure condition of the mining machine unit is detected when the determined position change does not exceed a threshold, and wherein a proper condition of the mining machine unit is detected when the determined position change is equal to or exceeds the threshold.

7. The method according to claim 1, further comprising determining a stroke change of the actuator during its actuating operation, wherein the step of detecting a malfunction of the mining machine unit is performed based on the determined stroke change.

8. The method according to claim 7, wherein the determined stroke change is indicative of a stroke change length, in particular with respect to an initial stroke of the actuator prior to being operated in its actuating operation.

9. The method according to claim 7, wherein the failure condition of the mining machine unit is detected when the determined stroke change and the determined position change do not correlate, and wherein the proper condition of the mining machine unit is detected when the determined stroke change and the determined position change correlate.

10. The method according to claim 7, wherein the failure condition is detected when an absolute value of the determined stroke change is greater than a first threshold or when an absolute value of the determined position change is lower than a second threshold, and wherein the proper condition is detected when an absolute value of the determined stroke change is equal to or greater than the first threshold and an absolute value of the determined position change is equal to or greater than the second threshold.

11. The method according to claim 10, wherein the second threshold is determined based on the determined stroke change.

12. The method according to claim 1, wherein the actuator is connected to at least one of the shield unit and the material removing unit by means of a shear pin which is configured to release a connection between the actuator and the at least one of the shield unit and material removing unit when a mechanical force acting on the shear pin exceeds a predetermined value.

13. The method according to claim 1, wherein the actuator is a linear actuator, in particular a telescopic actuator comprising a cylinder secured to the shield unit and a piston secured to the material removing unit.

* * * * *